US008807673B2

(12) United States Patent
Benigni

(10) Patent No.: US 8,807,673 B2
(45) Date of Patent: Aug. 19, 2014

(54) REFRIGERATOR AND/OR FREEZER

(75) Inventor: Karl Benigni, Oberdrauburg (AT)

(73) Assignee: Liebherr-Hausgeräte Lienz GmbH, Lienz (AT)

( * ) Notice: Subject to any disclaimer, the term of this patent is extended or adjusted under 35 U.S.C. 154(b) by 798 days.

(21) Appl. No.: 12/284,213

(22) Filed: Sep. 19, 2008

(65) Prior Publication Data

US 2009/0096332 A1 Apr. 16, 2009

(30) Foreign Application Priority Data

Sep. 20, 2007 (DE) ..... 20 2007 013 172 U

(51) Int. Cl.
*A47B 96/04* (2006.01)

(52) U.S. Cl.
USPC ..... 312/407; 312/401

(58) Field of Classification Search
USPC ..... 312/407, 401, 406, 404, 408; 62/440
See application file for complete search history.

(56) References Cited

U.S. PATENT DOCUMENTS

| | | | | |
|---|---|---|---|---|
| 2,815,649 | A | 12/1957 | Di Angelus et al. | |
| 3,989,329 | A * | 11/1976 | Benford | 312/406 |
| 3,991,537 | A * | 11/1976 | Brown | 52/718.05 |
| 4,067,628 | A * | 1/1978 | Sherburn | 312/407 |
| 4,632,470 | A * | 12/1986 | Jenkins et al. | 312/407 |
| 4,955,676 | A * | 9/1990 | Weaver et al. | 312/407 |
| 5,366,284 | A * | 11/1994 | Baker et al. | 312/404 |
| 5,641,217 | A * | 6/1997 | Caruso et al. | 312/404 |
| 6,113,205 | A * | 9/2000 | Kuo | 312/334.7 |
| 6,350,002 | B1 * | 2/2002 | Takaoka et al. | 312/407 |
| 8,037,708 | B2 * | 10/2011 | Cho et al. | 62/285 |
| 2001/0003408 | A1 * | 6/2001 | Otto et al. | 312/407 |
| 2003/0071550 | A1 * | 4/2003 | Wolanin et al. | 312/406 |
| 2005/0017618 | A1 * | 1/2005 | Myers et al. | 312/406 |
| 2006/0254481 | A1 * | 11/2006 | Lee et al. | 108/108 |
| 2007/0152551 | A1 * | 7/2007 | Kim et al. | 312/401 |
| 2007/0228907 | A1 * | 10/2007 | Luisi et al. | 312/404 |
| 2012/0313497 | A1 * | 12/2012 | Jang et al. | 312/405 |

FOREIGN PATENT DOCUMENTS

| | | |
|---|---|---|
| CA | 2492357 | 7/2006 |
| DE | 940354 | 3/1956 |
| DE | 202006005548 | 6/2006 |
| DE | 102005045326 | 3/2007 |
| EP | 1808657 | 7/2007 |

* cited by examiner

*Primary Examiner* — Daniel Rohrhoff
(74) *Attorney, Agent, or Firm* — Dilworth & Barrese, LLP.

(57) ABSTRACT

A refrigerator and/or freezer has at least one interconnecting element extending between two compartments of the appliance, wherein one or more holding members are provided, which are connected with the inner container of the appliance and on which the interconnecting element is arranged such that the holding member at least partly extends between the inner container and the interconnecting element.

15 Claims, 2 Drawing Sheets

REFRIGERATOR AND/OR FREEZER

BACKGROUND OF THE INVENTION

The present invention relates to a refrigerator and/or freezer with at least one interconnecting element extending between two compartments of the appliance.

Refrigerators and/or freezers with two or more than two separate compartments are known in a number of different embodiments. The individual compartments each have a door, between which a metallic interconnecting element extends in the appliances known from the prior art, which stabilizes the housing and provides the supporting surface for the magnetic door seals.

Novel appliances have a housing structure, in which the inner container is only made in one piece, which results in that the interconnecting element makes a firm mechanical connection with the inner container only at the two outer portions. In the middle portion, the interconnecting element is attached to the inner container only by the PU foam or multi-component foam used for insulating purposes.

Such mounting of the interconnecting element does not ensure process safety and a sufficient service life due to several parameters such as foaming temperature, foam ageing, tensile magnetic force, penetration of various media, etc.

SUMMARY OF THE INVENTION

Therefore, it is the object underlying the present invention to develop a refrigerator and/or freezer as mentioned above such that a permanently stable attachment of the interconnecting element is achieved.

This object is solved by a refrigerator and/or freezer with the features herein. Accordingly, it is provided that one or more holding members are provided, which are connected with the inner container of the appliance and on which the interconnecting element is arranged such that the holding member at least partly extends between the inner container and the interconnecting element. In accordance with the invention, one or more additional holding members thus are provided, by means of which the interconnecting element preferably is indirectly fixed at the inner container along its entire length. Largely any kind of attachment of the holding member(s) to the inner container is possible. Mechanical fastening means such as screws, clips, rivets, etc. are conceivable.

With the configuration of the appliance in accordance with the invention it is furthermore possible to meet the requirement of a floating inner container, which is required for foaming the appliances, although this is no absolutely necessary feature of the present invention.

The holding member(s) can be mounted to the inner container without a major additional effort. By means of the holding member(s) it is possible to permanently fix the interconnecting element at the inner container or at the holding member(s) connected with the inner container. Bulging of the interconnecting element to the front thus can be avoided in accordance with the invention.

As explained above, the holding member(s) can be connected with the inner container by means of a mechanical connection. The connection between holding member and inner container can for instance be effected by a screw, clip or rivet connection.

The present invention can be realized with one holding member or also with a plurality of holding members which preferably are arranged one beside the other.

The holding member(s) can include at least one holder, which preferably constitutes a web and by means of which the interconnecting element is positively fixed at the holding member. Other configurations such as a frictional connection of the interconnecting element to the holding member(s) are of course also conceivable.

In a further aspect of the invention it is provided that the holding member(s) include(s) at least one holder for receiving a frame heater.

Furthermore, it can be provided that the holding member(s) include(s) at least one bore for receiving a fastening element, preferably a screw, for fixing at the inner container. This bore can be disposed for instance in a region between two holders for fixing the interconnecting element at the holding member.

As explained, the connection between the holding member (s) and the inner container can be effected by means of a screw connection. It can be provided that on the side of the inner container facing away from the at least one holding member a receiving element is disposed, in which the screw, for instance the threaded portion thereof, is at least partly received.

The receiving element can include one, two or more than two, preferably a plurality of bores for receiving a portion of the screw. The advantage of using such receiving element consists in that the same need not be positioned exactly. Rather, approximately positioning the same is sufficient due to the plurality of existing bores. By means of the receiving element, the screw and thus the holding member is safely fixed.

In a further aspect of the invention it is provided that the receiving element is bonded to the side of the inner container facing away from the holding member(s). It is conceivable that the receiving element includes an adhesive layer, by means of which it is arranged on the inside of the inner container.

The holding member(s) can extend along the entire length or along an essential part of the length of the interconnecting element, which involves the advantage that the interconnecting element is mechanically fixed in a particularly safe way and the probability for the bulging of the interconnecting element is minimized.

As explained above, an advantageous aspect of the invention consists in that the inner container is floatingly accommodated in the appliance.

BRIEF DESCRIPTION OF THE DRAWINGS

Further details and advantages of the invention will be explained with reference to an embodiment illustrated in the drawing, in which.

DESCRIPTION OF THE PREFERRED EMBODIMENTS

Figure 1:
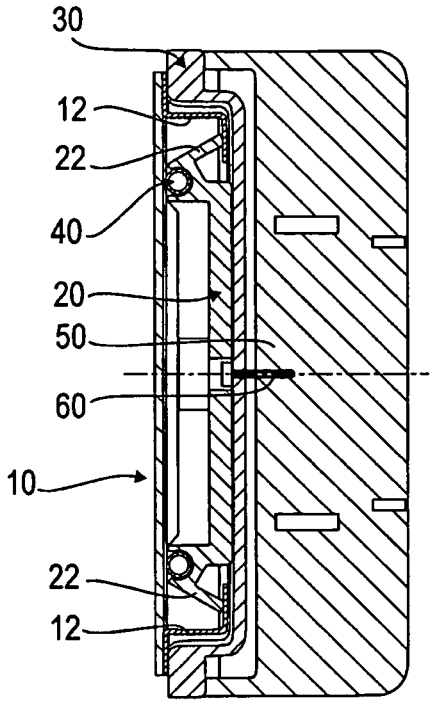
FIG. 1: shows a sectional representation through the refrigerator and/or freezer of the invention at the level of the interconnecting element.

The refrigerator and/or freezer includes at least two separate compartments which can each be closed by a door or flap and between which the interconnecting element 10 shown in FIG. 1 extends on the front side. The interconnecting element 10 constitutes a strip extending in tranverse direction of the appliance.

In FIG. 1, reference numeral 30 designates the inner container, which is slightly set back at the level of the interconnecting element 10, i.e. has an indentation extending in transverse direction of the appliance. Between the interconnecting element 10 and the one- or multi-part inner container 30 the holding member 20 shown in perspective in FIG. 2 extends in the vicinity of said indentation.

Via a screw connection, i.e. by means of the screw 60 shown in FIG. 1, the holding member 20 is connected with the inner container 30. The screw 60 is guided through the bore 26 of the holding member 20 and fixed in the receiving element 50, which is located on the side of the inner container 30 facing away from the holding member 20.

The receiving element 50 includes a plurality of bores and is bonded to the inside of the inner container 30. It is the function of the receiving element 50 to form a bearing for the screw 60, so as to reliably fix the holding member(s) 20 at the inner container 30.

Figure 2:
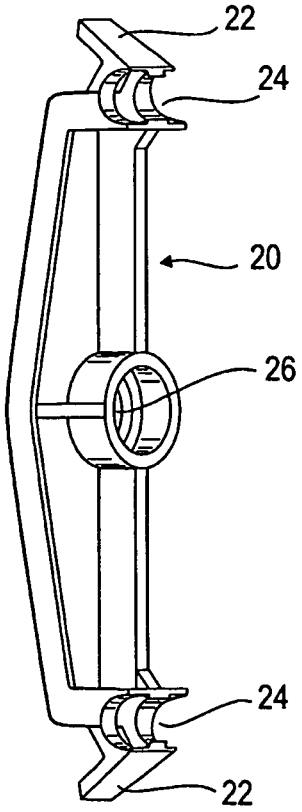
FIG. 2: shows a perspective representation of a holding member in accordance with the present invention.
Figure 3:
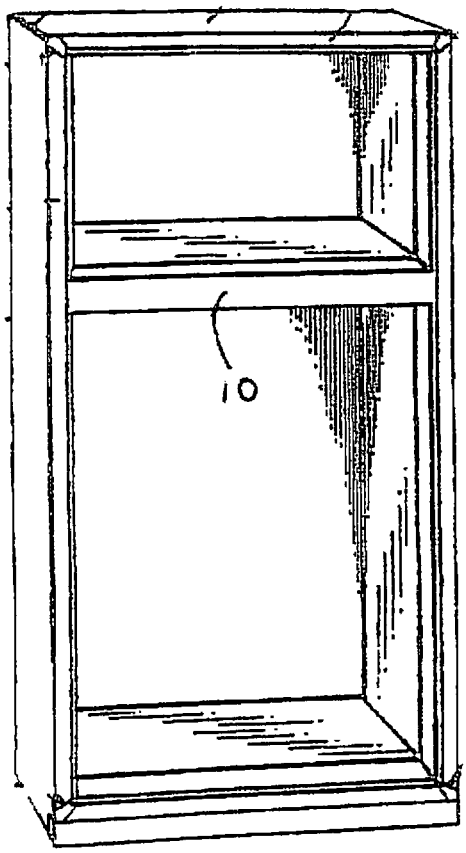
Fig. 3 PRIOR ART
FIG. 3: shows a perspective view of a refrigerator/freezer having two compartments and on which the holding member and interconnecting element are mounted.

As can in particular also be taken from FIG. 2, the holding member 20 has a substantially vertical extension and is connected with one holder 22 each at its upper and lower edge portions. This holder is positively connected with an angled protrusion 12 of the interconnecting element 10 and thus retains the interconnecting element 10 at the holding member 20, as can be taken in particular from FIG. 1.

In the vicinity of the holders 22, there is furthermore provided one holder 24 each for receiving a frame heater 40.

By using the holding member 20 of the invention, a permanent and exact positioning of the interconnecting element 10 at the inner container 30 also is ensured, if the insulating foam should loose its holding force after some years. Furthermore, the holding member 20 provides for an exact positioning of the frame heater 40.

As a further advantage, it should be mentioned that a floating support of the inner container 30 is possible, which is advantageous when foaming the appliance.

As explained above, one holding member or also several holding members can be used to connect the interconnecting element 10 with the inner container 30.

In contrast to the embodiment shown in FIG. 2, the holding member 20 can be configured wider and thus extend over a greater part of the interconnecting element in transverse direction. As explained above, the use of several holding members arranged for instance one beside the other also is conceivable.

The invention claimed is:

1. An appliance having at least one of a refrigerator and freezer with at least one interconnecting element (10) configured to be positioned and extend between two compartments within the appliance having an interior container (30), wherein at least one holding member (20) is provided, which is connected with both a partition extending between the two compartments of the inner container (30) of the appliance and the interconnecting element (10), the at least one holding member (20) including at least one holder (22) positively and/or frictionally fixing the interconnecting element (10) to the at least one holding member (20) and thereby fixing the interconnecting element (10) to the inner container (30) partition and extending between the inner container (30) partition and the interconnecting element (10), the interconnecting element (10) is in the form of a strip extending in a transverse direction in a front portion of the appliance, the at least one holding member (20) is affixed to the partition at least at one location situated between transverse ends of the interconnecting element (10), and the interconnecting element (10) is affixed to the inner container (30) along an entire length thereof through the at least one holding member (20).

2. The appliance according to claim 1, wherein the at least one holding member (20) is connected with the inner container (30) by a mechanical connection.

3. The appliance according to claim 2, wherein the at least one holding member (20) is connected with the inner container (30) by a screw, clip or rivet connection.

4. The appliance according to claim 1, wherein the at least one holding member (20) includes at least one holder (24) for receiving a frame heater (40).

5. The appliance according to claim 1, wherein the at least one holding member (20) includes at least one bore (26) for receiving means for fastening the at least one holding member (20) to the inner container (30).

6. The appliance according to claim 1, wherein the at least one holding member (20) is connected with the inner container (30) by a screw connection and on the side of the inner container (30) facing away from the at least one holding member (20), a receiving element (50) is disposed for at least partly receiving the screw (60).

7. The appliance according to claim 6, wherein the receiving element includes at least one bore (26) for receiving a portion of the screw (60).

8. The appliance according to claim 6, wherein the receiving element (50) is bonded to the side of the inner container (30) facing away from the at least one holding member (20).

9. The appliance according to claim 1, wherein along substantially the entire length of the interconnecting element (10), the at least one holding member (20) is connected with the interconnecting element (10) and with the inner container (30).

10. The appliance according to claim 1, wherein the inner container possesses an indentation extending in a transverse direction of the appliance for receiving the at least one holding member (20).

11. The appliance according to claim 1, wherein the interconnecting element (10) is arranged as a support for magnetic door seals.

12. An appliance having at least one of a refrigerator and freezer with at least one interconnecting element (10) configured to be positioned and extend between two compartments within the appliance having an interior container (30), wherein at least one holding member (20) is provided, which is connected with both a partition extending between the two compartments of the inner container (30) of the appliance and the interconnecting element (10), the at least one holding member (20) positively connected with the interconnecting element (10) and thereby fixing the interconnecting element (10) to the inner container (30) partition and extending between the inner container (30) partition and the interconnecting element (10), the interconnecting element (10) is in the form of a strip extending in a transverse direction in a front portion of the appliance, the at least one holding member (20) is affixed to the partition at least at one location situated between transverse ends of the interconnecting element (10), the interconnecting element (10) is affixed to the inner container (30) along an entire length thereof through the at least one holding member (20), the interconnecting element (10) comprises angled protrusions (12) on opposite ends thereof and extending around edges of the at least one holding member (20), and the at least one holding member (20) comprises first holders (22) at the opposite edges thereof and configured to be outwardly-flared in a direction facing away from the interconnecting element (10) and towards the partition when connected to the partition, for positive connection with the angled protrusions (12) of the interconnecting element (10) to thus retain the interconnecting element (10) in engagement with the at least one holding member (20) and interior container (30) along the entire length of the interconnecting element (10).

13. The appliance according to claim 12, wherein the at least one holding member (20) additionally comprises second holders (24) positioned at the opposite edges thereof adjacent and inwardly of the respective first holders (22), with the second holders (24) configured to receive and retain a frame heater (40).

14. The appliance according to claim 12, wherein the first holders (22) are outwardly-flared and arranged to contact the angled protrusions (12) of the interconnecting element (10) from an inner side or direction.

15. An appliance having at least one of a refrigerator and freezer with at least one interconnecting element (10) configured to be positioned and extend between two compartments within the appliance having an interior container (30), wherein at least one holding member (20) is provided, which is connected with both a partition extending between the two compartments of the inner container (30) of the appliance and the interconnecting element (10), the at least one holding member (20) positively connected with the interconnecting element (10) and thereby fixing the interconnecting element (10) to the inner container (30) partition and extending between the inner container (30) partition and the interconnecting element (10), the interconnecting element (10) is in the form of a strip extending in a transverse direction in a front portion of the appliance, the at least one holding member (20) is affixed to the partition at least at one location situated between transverse ends of the interconnecting element (10), the interconnecting element (10) is affixed to the inner container (30) along an entire length thereof through the at least one holding member (20), the at least one holding member (20) is connected with the inner container (30) by a screw connection and on the side of the inner container (30) facing away from the at least one holding member (20), a receiving element (50) is disposed for at least partly receiving the screw (60), the receiving element includes at least one bore (26) for receiving a portion of the screw (60), and the at least one holding member (20) additionally comprises first holders (22) at opposite edges thereof and configured for positive connection with the interconnecting element (10) to thus retain the interconnecting element (10) in engagement with the holding member (20), and second holders (24) positioned adjacent the respective first holders (22) and between the respective first holders (22) and the bore (26), with the second holders (24) configured to receive and retain a frame heater (40).

* * * * *